US009557104B1

(12) United States Patent
Smith et al.

(10) Patent No.: US 9,557,104 B1
(45) Date of Patent: Jan. 31, 2017

(54) CONDENSATION COLLECTION SYSTEM

(71) Applicant: Breakthrough Engenuity, LLC, Bixby, OK (US)

(72) Inventors: Robert Fred Smith, Grand Junction, CO (US); Will Dexter Ball, IV, Bixby, OK (US)

(73) Assignee: Breakthrough Engenuity, LLC, Bixby, OK (US)

( * ) Notice: Subject to any disclaimer, the term of this patent is extended or adjusted under 35 U.S.C. 154(b) by 807 days.

(21) Appl. No.: 13/764,908

(22) Filed: Feb. 12, 2013

(51) Int. Cl.

| | |
|---|---|
| ***F25J 3/00*** | (2006.01) |
| ***F25J 3/06*** | (2006.01) |
| ***E21B 43/00*** | (2006.01) |
| ***E21B 43/34*** | (2006.01) |
| ***C10L 3/10*** | (2006.01) |

(52) U.S. Cl.
CPC ..... *F25J 3/061* (2013.01); *C10L 3/101* (2013.01); *C10L 3/106* (2013.01); *E21B 43/00* (2013.01); *E21B 43/34* (2013.01); *F25J 3/062* (2013.01); *F25J 3/064* (2013.01); *F25J 3/0635* (2013.01); *F25J 2290/42* (2013.01); *F25J 2290/70* (2013.01)

(58) Field of Classification Search
CPC ..... F25J 3/061; F25J 3/062; F25J 2290/70; F25J 3/0635; F25J 3/064; F25J 2290/42; E21B 43/00; E21B 43/34; C10L 3/101; C10L 3/106
USPC ..... 62/618
See application file for complete search history.

(56) References Cited

U.S. PATENT DOCUMENTS

| | | | | |
|---|---|---|---|---|
| 4,597,437 | A * | 7/1986 | McNabb | E21B 43/34 166/79.1 |
| 4,779,677 | A | 10/1988 | Cobb | |
| 5,221,302 | A | 6/1993 | Sheehan | |
| 5,928,519 | A | 7/1999 | Homan | |
| 6,221,131 | B1 | 4/2001 | Behling et al. | |
| 6,955,704 | B1 * | 10/2005 | Strahan | B01D 53/22 166/267 |
| 7,507,280 | B2 | 3/2009 | Tomshak et al. | |
| 8,162,568 | B2 | 4/2012 | Goheen et al. | |
| 8,268,051 | B2 | 9/2012 | Hess | |
| 2003/0225169 | A1 | 12/2003 | Yetman | |
| 2009/0107218 | A1 * | 4/2009 | Latham | G01N 33/241 73/61.44 |
| 2014/0130676 | A1 * | 5/2014 | Daniels | B01D 19/0042 96/188 |
| 2014/0174122 | A1 * | 6/2014 | Cooper | F25J 3/061 62/618 |

* cited by examiner

*Primary Examiner* — Keith Raymond
(74) *Attorney, Agent, or Firm* — Millikin Intellectual Property Law, PLLC; Margaret Millikin

(57) ABSTRACT

A self contained, trailer mounted condensation collection system for an oil and gas well. The system has a condenser for cooling and condensing those oil well gases that can be condensed and a separator for separating the condensed portion from the non-condensable portion of the gas stream so that the condensed gases can be recovered as liquid hydrocarbons. The system is powered by the gas pressure from the well and operates without any outside utilities so that it can be used at new well sites where infrastructure has not been built to support the well.

15 Claims, 2 Drawing Sheets

CONDENSATION COLLECTION SYSTEM

BACKGROUND OF THE INVENTION

1. Field of the Invention

The present invention is a self contained, trailer mounted system with condenser for cooling and condensing those oil well gases that can be condensed and with a separator for separating the condensed portion from the non-condensable portion of the gas stream so that they can be recovered as liquid hydrocarbons. The system is powered by the gas pressure from the well and operates without any outside utilities so that it can be used at new well sites where infrastructure has not been built to support the well.

2. Description of the Related Art

In today's era of oil and gas well drilling, often wells will be drilled in remote locations where there are no utilities and no gas gathering pipelines. In shale areas such as the Baaken, Marcellus, Utica, and Eagle Ford areas, the wells are known to produce significant quantities of very light gravity crude oil, condensate (also known as natural gas liquids or NGLs) and natural gas in abundance. Since the completion technologies are relatively new, and these fields are quite large in geographical area, they lack the infrastructure necessary to bring all of the hydrocarbons into the commercial stream. At these wells, it has not been feasible to condense those hydrocarbons that exit the wellhead in gaseous state that might otherwise have been condensed to a liquid state and pumped to an oil tank. Therefore, large quantities of valuable hydrocarbon liquid rich natural gas are being released into the atmosphere, either directly or through venting or flaring. Often the condensable hydrocarbons are being burned with the non-condensable gases in flares at the wellhead, resulting in the loss of a large amount of recoverable hydrocarbons. With the high price of petroleum, this loss can add up to a considerable loss of revenue.

Also, the state and locate EPA offices in North Dakota, Pennsylvania, Ohio and Texas are now requiring that all wellhead gas be conditioned to remove as much of the valuable natural gas liquids as possible. This adds to the need for a new technology to remove the natural gas liquids prior to venting or flaring.

At the majority of these new wells, all gas and valuable natural gas liquids are being flared and completely destroyed by burning. The present system condenses and captures a portion of the valuable hydrocarbon liquids before they are sent to the flare, increasing the amount of hydrocarbon liquids entering the economic stream, and minimizing the waste and pollution associated with burning these valuable and much-needed products.

Also, burning hydrocarbon liquids generates considerable air pollution. This sort of air pollution was targeted in the Clean Air Act of 1970 as a known carcinogen. The present invention not only returns valuable hydrocarbons to the economic stream, it also generates a "green" benefit by reducing smog and the health hazards associated with it.

The present invention addresses this problem by providing a trailer mounted condensate collection system that is capable of using the pressure from the well to operate the system without the need for outside utilities. The system is a trailer mounted condensate optimization system designed to capture otherwise flared or lost hydrocarbon liquids. The system includes a trailer mounted condenser and a trailer mounted separator. It is specifically designed to be rugged enough for transportation to any well site on what are typically rough lease roads.

The present system treats the gases flowing from the well to condense, separate, and recover those gases that are capable of being condensed to a liquid from those gases that are non-condensable. Once on site, the system is connected to the well's flow line on the inlet end of the system and to the oil storage tank. The system is also connected on its outlet end to a flare, a vent stack or a gas pipeline when a gas pipeline is available.

The system uses pressure from the well to operate a fan that blows ambient air across a heat exchanger where those hydrocarbons from the wellhead that can be condensed will cool sufficiently to condense to a liquid state.

From the heat exchanger, the mixed gaseous and liquid effluent then flows through a separator where the effluent is initially used to heat the separator and then the effluent is introduced into the separator where the liquid portion is separated from the gaseous portion. The separated liquid portion is discharged to an oil storage tank where the liquids that flowed from the well are stored, and the separated gaseous portion is discharged to a flare to be burned or to a gas pipeline when one is available.

As any oil and gas producing area matures, the infrastructure grows to accommodate the need to gather, refine, and process the hydrocarbons to the greatest benefits of the owners. As this infrastructure is put in place the need for wellhead gas liquids condensation systems will shift to areas still outside the influence of infrastructure systems. Wells still remote to new gas gathering pipeline systems and gas plants will still need mobile condensation collection systems like the present invention, at least until the entire field is blanketed by the necessary pipeline networks. In the known shale oil areas of the United States, these plays are so large it may be a century or more before the infrastructure development is truly complete. That assures the present invention a full and fertile future for many decades ahead.

With over 160 drilling rigs currently running in the Baaken within a 50 mile radius of Williston, N. Dak., and with the price of crude oil still rising steadily, the opportunities for the present system continue to grow. And the Baaken is just one basin and one area. The same conditions exist in other shale reserves.

Rigs are completing wells at a rate of about one per month from spud to completion of fracturing. Therefore, in the Baaken alone, nearly 2000 new wells were completed and brought on line in 2012. The extrapolation of this into a nationwide new shale oil and gas well development makes it clear that there is a great need for the present invention.

SUMMARY OF THE INVENTION

The present invention is a trailer mounted condensate collection system that is capable of using the pressure from the well to operate the system without the need for outside utilities. The system is a trailer mounted condensate optimization system designed to capture otherwise flared or lost hydrocarbon liquids. The system includes a trailer mounted condenser and a trailer mounted separator. It is specifically designed to be rugged enough for transportation to any well site on what are typically rough lease roads.

The present system treats the gases flowing from the well to condense, separate, and recover those gases that are capable of being condensed to a liquid from those gases that are non-condensable. Once on site, the system is connected to the well's flow line on the inlet end of the system and to the oil storage tank. The system is also connected on its outlet end to a flare, a vent stack or a gas pipeline when a gas pipeline is available.

As the gaseous stream from the well enters the system, the pressure is first reduced through a gas operated back pressure regulator valve to control the inlet pressure to the system. The system uses a stream of gas from the well to operate a gas powered fan that blows ambient air across an air heat exchanger where those hydrocarbons from the wellhead that can be condensed will cool sufficiently to condense to a liquid state. Once the pressure of the gaseous stream has been reduced, the gaseous stream then enters the air heat exchanger where the inlet gas is cooled to a temperature within 5-10 degrees from ambient air temperature. The air exchanger is a specially designed industrial horizontal in-fan with an under-mounted large diameter multi-blade fan below several horizontal passes of small diameter high pressure finned process gas/fluid containing tubes. The fan driven cooler moves ambient air across the various layers of finned tubes, cooling the tubes and thus the gases/liquids within the tubes, causing the once gaseous stream that entered the heat exchanger to condense to liquid and forming a mixture of gas and liquid within the tubes. This typically produces a temperature reduction of from 50-100 degrees Fahrenheit, depending on ambient conditions. The air exchanger is unique to this application in that its fan is driven by an air powered (or in this case gas powered) motor, eliminating the need for a conventional electric motor, since more often than not, electricity is not available on the target new well sites.

The cooled liquids and gases exit the exchanger and then enter into a horizontal chiller-separator mounted on the trailer. This specially designed separator has a finned process cooling coil in the lower liquid phase portion of the separator tank. The Jules Thompson cooling effect of the upstream components creates a rain-like environment inside the separator allowing otherwise lost hydrocarbon fractions to condense out of the gas phase into the liquid phase within the separator tank.

The finned process cooling coil in the bottom of the separator maintains the cool liquid temperature, stabilizing the liquid temperature to prevent re-evaporation. The result is a dramatic increase in recoverable hydrocarbon liquids.

As the stable hydrocarbon liquid volume grows inside the separator, a gas operated liquid level controller senses the liquid level and sends a signal to a special freeze-proof oil valve to open, allowing the recovered liquid oil to move on to storage. The much enhanced volume of recovered hydrocarbon liquid then flows through a long-life battery powered and highly accurate turbine flow meter that counts each barrel of oil in increments of 1/1000ths of a barrel and electronically totalizes the flow on a continuously readable LCD display. The oil then exits the trailer mounted system and the separated liquid oil portion is discharged to an oil storage tank where the liquids that flowed from the well are stored and is ready for sale as crude oil.

The remaining well stream or separated gaseous portion is now lean gas, free of condensable hydrocarbons. It is released or discharged from the trailer mounted system through a second gas operated back pressure valve from which it flows on to the lease flare stack to be burned, or alternately, to a gas pipeline when one is available.

DETAILED DESCRIPTION OF THE PREFERRED EMBODIMENT

Figure 1:
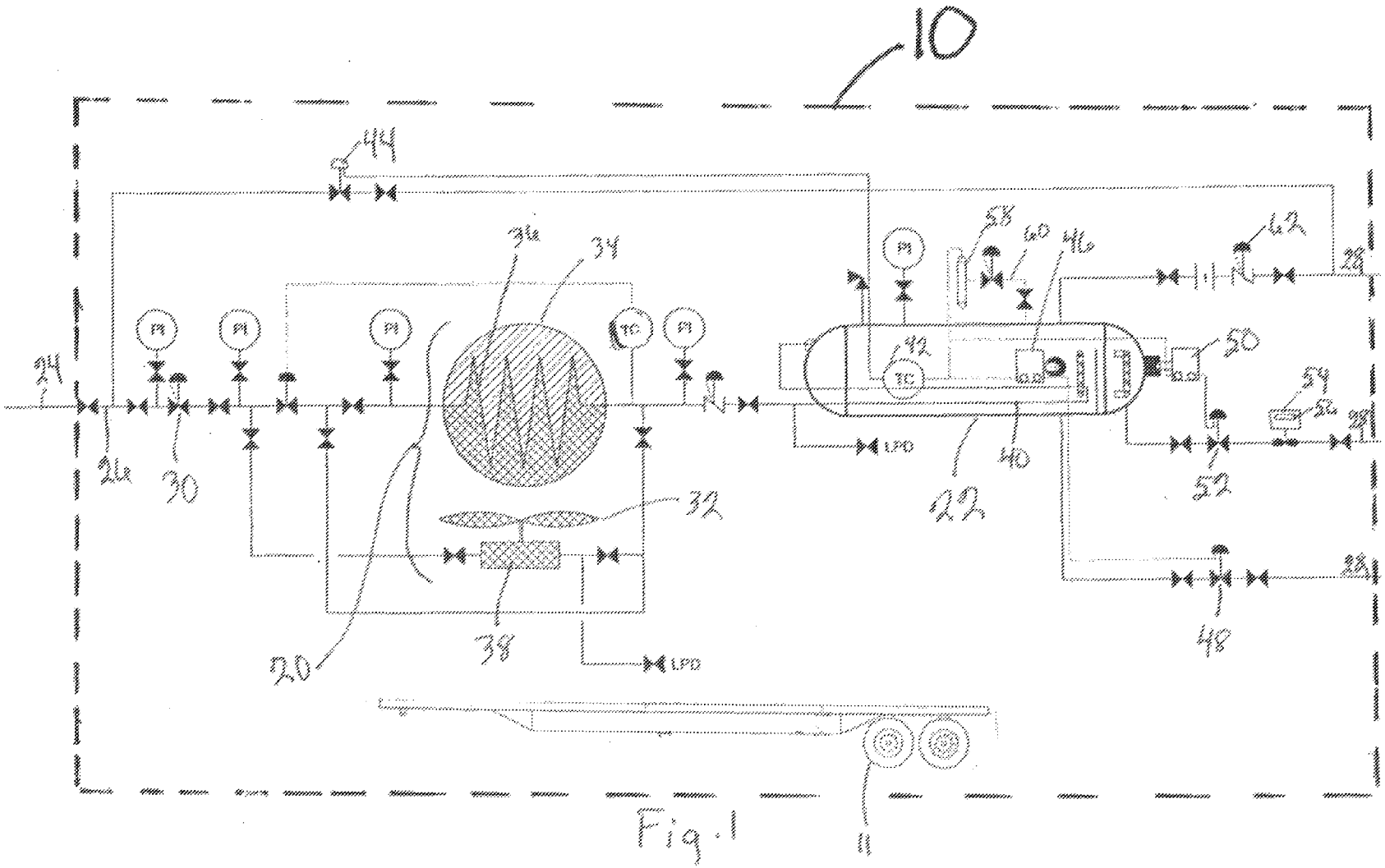
FIG. 1 is a diagram showing the component parts of the present invention in relationship to an oil well and in relationship to a gas flare, an oil tank and a waste water tank that are located at the well site.
Figure 2:
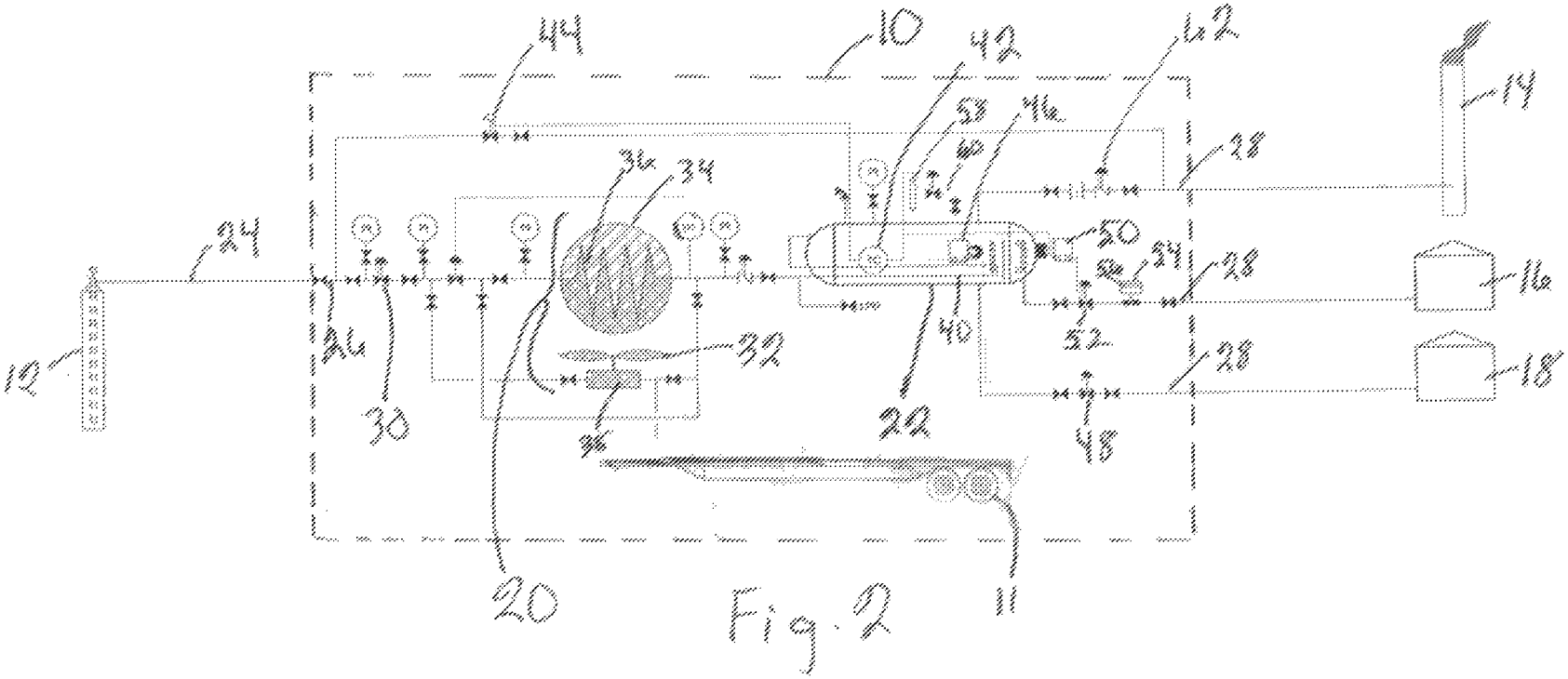
FIG. 2 is an enlarged view of the area within dashed line 10 of FIG. 1.

Referring now to FIGS. 1 and 2, there is illustrated a trailer mounted condensate collection system 10 constructed in accordance with a preferred embodiment of the present invention. FIG. 1 is a diagram of the component parts of the system 10 that are mounted on a trailer 11, with the components of the system 10 shown within the dashed line enclosure associated with numeral 10. FIG. 1 shows the trailer mounted system 10 in relationship to an oil and gas producing well 12 and in relationship to a gas flare 14, an oil storage tank 16 and a waste water tank 18 that are located at the well site.

The trailer mounted condensate collection system 10 is capable of using the gas pressure from the well 12 to operate the system 10 without the need for outside utilities. The trailer mounted condensate optimization system 10 is designed to capture otherwise flared or lost hydrocarbon liquids that would be exiting from the well 12 in the gas stream. The system 10 includes a trailer 11 on which is mounted a condenser 20 and a separator 22 and associated valves and equipment as will be described hereafter. It is specifically designed to be rugged enough for transportation to any well site over rough lease roads.

Referring now to the drawing, the system 10 will be described. The present system 10 treats the gases flowing from the well 12 to condense those gases that are capable of being condensed to a liquid, to separate the condensed liquids from those gases that are not condensed, and to recover those condensed liquids. Once on site, the system 10 is connected to the well's gas flow line 24 on the inlet end 26 of the system 10. On the outlet end 26 of the system 10, connections are made to an oil storage tank 16, to a waste water tank 18 and to either a flare 14, a vent stack (not illustrated) or a gas pipeline (also not illustrated), if a gas pipeline is available at the well site.

As the gaseous stream from the well 12 enters the system 10, the pressure is first reduced through a gas operated inlet back pressure regulator valve 30 to control the inlet pressure to the system 10. The system 10 uses a stream of gas from the well 12 to operate a pneumatic powered fan 32 that blows ambient air across an air heat exchanger 34 of the condenser 20. The air heat exchanger 34 is where those gaseous hydrocarbons from the well 12 that can be condensed will be cooled sufficiently to condense to a liquid state.

Once the pressure of the gaseous stream has been reduced, the gaseous stream then enters the air heat exchanger 34 of the condenser 20 where the inlet gas is cooled to a temperature that is within approximately 5-10 degrees from ambient air temperature. The condenser 20 is a specially designed industrial horizontal fin-fan air exchanger 34 with an under-mounted large diameter multi-blade fan 32 located below several horizontal passes of small diameter high pressure finned process gas containing heat exchanger tubes 36 containing the gaseous stream from the well 12. The fan driven cooler or condenser 20 moves ambient air across the various layers of finned tubes 36, cooling the tubes 36 and thus the gas within the tubes 36, causing a portion of the gaseous stream that entered the heat exchanger 34 to condense to liquid and forming a mixture of gas and liquid within the tubes 36. This typically produces a temperature reduction of the gas and liquid stream from 50-100 degrees Fahrenheit, depending on ambient conditions.

The air heat exchanger 34 is unique to this application in that its fan 32 is driven by an air powered fan motor 38. In this case the gas that powers the motor 38 is not air, but is instead the pressurized gas from the well 12. Use of this type of fan motor eliminates the need for a conventional electric motor, since more often than not, electricity is not available on the target new well sites.

The cooled mixture of liquids and gases exits the exchanger 34 and then enters into a horizontal chiller-separator 22 that is also mounted on the trailer 11 along with the air exchanger 34. This specially designed separator 22 has a finned process cooling coil 40 contained in the lower liquid phase portion of the separator 22. The Jules Thompson cooling effect of the upstream components creates a rain-like environment inside the separator 22 allowing otherwise lost hydrocarbon fractions to condense out of the gas phase into the liquid phase within the separator 22.

The finned process cooling coil 40 in the bottom of the separator 22 maintains the cool liquid temperature, stabilizing the liquid temperature to prevent re-evaporation. The result is a dramatic increase in recoverable hydrocarbon liquids.

The temperature within the separator 22 is monitored by a temperature controller 42 that opens a separate bypass control valve 44 to bypass the system 10 with the well's gas stream if the temperature within the separator 22 approaches temperatures low enough that the entrained water that was contained in the gas and liquid stream and is separated from the hydrocarbons in the separator 22 might be in danger of freezing within the separator 22 before it can be discharged to the waste water tank 18.

The separator 22 is provided with a gas operated water level controller 46 that senses the level of water within the separator 22 and sends a signal to activate a freeze-proof water dump valve 48 to open, allowing water to be discharged from the bottom of the separator 22 to maintain the proper water level in the separator 22. The discharged water flows from the system 10 and into the waste water tank 18.

As the stable hydrocarbon liquid volume grows inside the separator 22, a gas operated liquid level controller 50 senses the liquid level and sends a signal to a special freeze-proof oil valve 52 to open, allowing the recovered liquid oil to exit the separator 22. The much enhanced volume of recovered hydrocarbon liquid then flows through a long-life battery powered and highly accurate turbine flow meter 54 that counts each barrel of oil passing through the meter 54 in increments of 1/1000ths of a barrel and electronically totalizes the flow on a continuously readable LCD display 56. The separated liquid oil portion then exits the trailer mounted system 10 and flows to the oil storage tank 16 where the liquid hydrocarbons that initially flowed from the well 12 are stored and ready for sale as crude oil.

Referring back to the separator 22, a drip trap 58 is provided in-line on the gas line 60 that supplies control gas to the separator's temperature controller 42, to the oil liquid level controller 50 and to the water level controller 46 to protect these instruments by preventing liquids from reaching them in the control gas.

The remaining well stream or separated gaseous portion is now lean gas that is free of condensable hydrocarbons. It is released or discharged from the trailer mounted system 10 through a second gas operated back pressure valve 62 from which it flows on to the lease flare 14 to be burned, or alternately, to a gas pipeline when one is available at the well site. FIG. 1 shows the gaseous portion being conducted to a gas flare 14.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A condensation collection system comprising:

a self contained trailer suitable for moving natural gas liquids separation equipment to a remote oil and gas producing well, a condenser mounted on the trailer, said condenser having an inlet for receiving gas from an oil well's gas flow line and means for cooling and condensing a condensable portion of the gas that enters the condenser via the inlet, a separator mounted on the trailer, an outlet of the condenser connected to an inlet of the separator, said separator designed to receive effluent from the condenser and to separate the condenser effluent into a gas portion, a liquid hydrocarbon portion and a water portion, an oil conduit extending out of the separator for conducting the liquid hydrocarbon portion to an oil storage tank, a water conduit extending out of the separator for conducting the water portion from the separator, and a gas conduit extending out of the separator for conducting the gas portion out of the separator; wherein the means for cooling and condensing a condensable portion of the gas that enters the condenser further comprises a pneumatic powered fan that is powered by a stream of gas from the well, said fan mounted under the condenser so that the fan blows ambient air across a heat exchanger provided within the condenser.

2. A condensation collection system according to claim 1 wherein said fan is a large diameter multi-blade fan.

3. A condensation collection system according to claim 1 further comprising:

said condenser provided with several horizontal passes of small diameter high pressure finned process gas containing heat exchanger tubes that receive the gas stream from the well and over which ambient air is blown by the fan to cool the gas stream flowing within the tubes and condense a portion of the gas stream to form a mixture of gas and liquid effluent that exits the condenser.

4. A condensation collection system according to claim 1 further comprising:

a gas operated inlet back pressure regulator valve provided upstream of the condenser inlet to reduce and control the pressure of the gas flowing to the condenser and to the pneumatic powered fan.

5. A condensation collection system according to claim 1 wherein the separator is horizontally mounted on the trailer.

6. A condensation collection system according to claim 5 further comprising:

a process heating coil provided in the bottom of the separator for receiving the effluent from the condenser before the effluent is introduced into a separation section of the separator as a means of heating and stabilizing liquids within the bottom of the separator to prevent freezing within the separator.

7. A condensation collection system according to claim 6 further comprising:

a temperature controller attached to the separator that monitors the temperature of the separator and opens a bypass control valve that allows the well's gas stream to bypass the condenser and separator if the temperature within the separator approaches temperatures low enough that water in the separator can freeze.

8. A condensation collection system according to claim 7 further comprising:

a gas operated water level controller attached to the separator that senses the level of the water portion within the separator and sends a signal to activate a freeze-proof water dump valve to open and discharge water from the separator via the water conduit in order to maintain a water level in the bottom of the separator.

9. A condensation collection system according to claim 8 further comprising:

a gas operated liquid level controller attached to the separator that senses the level of the liquid hydrocarbon portion within the separator and sends a signal to a freeze-proof oil valve to open and discharge oil from the separator via the oil conduit in order to maintain an oil level in the separator.

10. A condensation collection system according to claim 9 further comprising:

a battery powered turbine flow meter provided in the oil conduit that counts each barrel of oil passing through the oil conduit.

11. A condensation collection system according to claim 10 further comprising:

said turbine flow meter electronically totalizes the flow of oil passing through the oil conduit and displays the total barrels on a continuously readable LCD display.

12. A condensation collection system according to claim 10 further comprising:

a drip trap provided in-line on a gas line that supplies control gas to the separator's temperature controller, to the separator's oil liquid level controller and to the separator's water level controller to protect each controller by preventing liquids from reaching each controller in the control gas.

13. A condensation collection system according to claim 1 further comprising:

a second gas operated back pressure valve provided on the gas conduit for allowing the gas portion to exit the separator.

14. A condensation collection system according to claim 13 wherein the gas conduit for conducting the gas portion out of the separator connects to one of the following:

a gas flare, a vent stack, or a gas pipeline.

15. A condensation collection system according to claim 1 wherein the water conduit for conducting the water portion out of the separator connects to a waste water tank.

* * * * *